US005158745A

United States Patent [19]

Hasegawa et al.

[11] Patent Number: 5,158,745

[45] Date of Patent: Oct. 27, 1992

[54] HIGH-NITROGEN FERRITIC HEAT-RESISTING STEEL

[75] Inventors: Yasushi Hasegawa, Kanagawaken, Japan; Peter Ernst, Niederglatt, Switzerland; Fujimitsu Masuyama, Nagasakiken, Japan

[73] Assignees: Nippon Steel Corporation; Mitsubishi Jukogyo Kabushiki Kaisha, both of Tokyo, Japan

[21] Appl. No.: 655,584

[22] Filed: Feb. 15, 1991

[30] Foreign Application Priority Data

Feb. 19, 1990 [JP] Japan ..... 2-37895

[51] Int. Cl.[5] ..... C22C 38/22

[52] U.S. Cl. ..... 420/66; 420/68; 420/69

[58] Field of Search ..... 420/66, 68, 69

[56] References Cited

U.S. PATENT DOCUMENTS 2,880,085 3/1959 Kirkby et al. ..... 426/66

FOREIGN PATENT DOCUMENTS 54-102221 8/1979 Japan ..... 420/66

64-129282 5/1989 Japan .

*Primary Examiner*—Deborah Yee

*Attorney, Agent, or Firm*—Wenderoth, Lind & Ponack

[57] ABSTRACT

A high-nitrogen ferritic heat-resisting steel comprises, in weight per cent, 0.01–0.30% C, 0.02–0.80% Si, 0.20–1.00% Mn, 8.00–13.00% Cr, 0.50–3.00% W, 0.005–1.00% Mo, 0.05–0.50% V, 0.02–0.12% Nb and 0.10–0.50% N and is controlled to include not more than 0.050% P, not more than 0.010% S and not more than 0.020% O, the balance being Fe and unavoidable impurities. The steel may optionally comprise (A) one or both of 0.01–1.00% Ta and 0.01–1.00% Hf and/or (B) or both of 0.0005–0.10% Zr and 0.01–0.10% Ti. A method of producing the steel comprises melting and equilibrating the steel components in an atmosphere of a mixed gas of a prescribed nitrogen partial pressure or nitrogen gas and thereafter casting or solidifying the melt in an atmosphere controlled to have a nitrogen partial pressure of not less than 1.0 ata and a total pressure of not less than 4.0 ata, with the relationship between the partial pressure p and the total pressure $P_t$ being $$10^{P} < P_t^{0.37} + \log_{10} 6.$$

4 Claims, 8 Drawing Sheets

HIGH-NITROGEN FERRITIC HEAT-RESISTING STEEL

BACKGROUND OF THE INVENTION

1. Field of the Invention

This invention relates to a high-nitrogen ferritic heat-resisting steel, more particularly to a high-nitrogen ferritic heat-resisting steel containing chromium, and which is appropriate for use in a high-temperature, high-pressure environment, and to a method of producing the same.

2. Description of the Prior Art

Recent years have seen a marked increase in the temperatures and pressures under which thermal power plant boilers are required to operate. Some plans already call for operation at 566° C. and 310 ata and it is expected that operation under conditions of 650° C. and 350 ata will be implemented in the future. These are extremely severe conditions from the viewpoint of the boiler materials used.

At operating temperatures exceeding 550° C., it has, from the viewpoints of oxidation resistance and high-temperature strength, been necessary to switch from ferritic 2 . ¼ Cr-1 Mo steel to high-grade austenitic steels such as 18-8 stainless steel. In other words, it has been necessary to adopt expensive materials with properties exceeding what is required.

Decades have been spent in search of steels for filling in the gap between 2 . ¼ Cr-1 Mo steel and austenitic stainless steel. Medium Cr (e.g. 9 Cr and 12 Cr) steel boiler pipes are made of heat-resisting steels that were developed against this background. They achieve high-temperature strength and creep rupture strength on a par with austenitic steels by use of a base metal composition which includes various alloying elements for precipitation hardening and solution hardening.

The creep rupture strength of a heat-resisting steel is governed by solution hardening in the case of short-term aging and by precipitation hardening in the case of long-term aging. This is because the solution-hardening elements initially present in solid solution in the steel for the most part precipitate as stable carbides such as $M_{23}C_6$ during aging, and then when the aging is prolonged these precipitates coagulate and enlarge, with a resulting decrease in creep rupture strength.

Thus, with the aim of maintaining the creep rupture strength of heat-resisting steels at a high level, a considerable amount of research has been done for discovering ways for avoiding the precipitation of the solution hardening elements and maintaining them in solid solution for as long as possible.

For example, Japanese Patent Public Disclosures No. 63(1988)-89644, 61(1986)-231139 and 62(1987)-297435 disclose ferritic steels that achieve dramatically higher creep rupture strength than conventional Mo-containing ferritic heat-resisting steels by the use of W as a solution hardening element.

While the solution hardening by W in these steels may be more effective than by Mo, the precipitates are still fundamentally carbides of the $M_{23}C_6$ type, so that it is not possible to avoid reduction of the creep rupture strength following prolonged aging.

Moreover, the use of ferritic heat-resisting steels at up to 650° C. has been considered difficult because of their inferior high-temperature oxidation resistance as compared with austenitic heat-resisting steels. A particular problem with these steels is the pronounced degradation of high-temperature oxidation resistance that results from the precipitation of Cr in the form of coarse $M_{23}C_6$ type precipitates at the grain boundaries.

The highest temperature for use of ferritic heat-resisting steel has therefore been considered to be 600° C.

The need for heat-resisting steels capable of standing up under extremely severe conditions has grown more acute not only because of the increasingly severe operating conditions mentioned earlier but also because of plans to reduce operating costs by extending the period of continuous power plant operation from the current 100 thousand hours up to around 150 thousand hours.

Although ferritic heat-resisting steels are somewhat inferior to austenitic steels in high-temperature strength and anticorrosion property, they have a cost advantage. Furthermore, for reasons related to the difference in thermal expansion coefficient, among the various steam oxidation resistance properties they are particularly superior in scale defoliation resistance. For these reasons, they are attracting attention as a boiler material.

For the reasons set out above, however, it is clearly not possible with the currently available technology to develop ferritic heat-resisting steels that are capable of standing up for 150 thousand hours under operating conditions of 650° C., 350 ata, that are low in price and that exhibit good steam oxidation resistance.

Through their research the inventors developed a high-nitrogen ferritic heat-resisting steel in which W is added in place of Mo as the main solution hardening element, thereby increasing the high-temperature strength, and nitrogen is forcibly added to the ferritic steel to a level of supersaturation, thereby causing dispersed precipitation of fine nitrides and carbo-nitrides which greatly delay the formation of $M_{23}C_6$ precipitates that would otherwise consume large quantities of Cr acting as an oxidation resistance enhancer, and W acting as a solution hardening agent. The inventors found that this steel exhibits stable creep rupture strength, superior high-temperature oxidation resistance and superior low-temperature toughness, and is capable of being applied under conditions of 650° C., 350 ata and 150 thousand hours of continuous operation.

There have been few papers published on research into high-nitrogen ferritic heat-resisting steels and the only known published report in this field is Ergebnisse der Werkstoff-Forschung, Band I, Verlag Schweizerische Akademieder Werkstoffwissenschaften "Thubal-Kain", Zurich, 1987, 161–180.

However, the research described in this report is limited to that in connection with ordinary heat-resisting steel and there is no mention of materials which can be used under such severe conditions as 650° C., 350 ata and 150 thousand hours continuous operation.

SUMMARY OF THE INVENTION

An object of this invention is to provide a high-nitrogen ferritic heat-resisting steel which overcomes the shortcomings of the conventional heat-resisting steels, and particularly to provide such a steel capable of being used under severe operating conditions wherein the decrease in creep rupture strength following prolonged aging and the degradation of high-temperature oxidation resistance caused by precipitation of carbides are mitigated by adding nitrogen to supersaturation so as to precipitate fine nitrides and/or carbo-nitrides which delay the formation of carbides such as the $M_{23}C_6$ precipitates seen in conventional steels Another object of the invention is to provide such a high-nitrogen ferritic heat-resisting steel imparted with superior high-temperature oxidation resistance and creep rupture strength by allowing nitrogen added to beyond the solution limit to precipitate in the form of nitrides and carbo-nitrides.

Another object of the invention is to provide a method of producing a high-nitrogen ferritic heat-resisting steel of the aforesaid type.

This invention was accomplished in the light of the aforesaid knowledge and, in one aspect, pertains substantially to a high-nitrogen ferritic heat-resisting steel comprising, in weight per cent, 0.01–0.30% C, 0.02–0.80% Si, 0.20–1.00% Mn, 8.00–13.00% Cr, 0.50–3.00% W, 0.005–1.00% Mo; 0.05–0.50% V, 0.02–0.12% Nb and 0.10–0.50% N and being controlled to include not more than 0.050% P, not more than 0.010% S and not more than 0.020% O, and optionally comprising (A) one or both of 0.01–1.00% Ta and 0.01–1.00% Hf and/or (B) one or both of 0.0005–0.10% Zr and 0.01–0.10% Ti, the balance being Fe and unavoidable impurities.

Another aspect of the invention pertains to a method of producing such a high-nitrogen ferritic heat-resisting steel wherein the steel components are melted and equilibrated in an atmosphere of a mixed gas of a prescribed nitrogen partial pressure or nitrogen gas and the resulting melt is thereafter cast or solidified in an atmosphere controlled to have a nitrogen partial pressure of not less than 1.0 ata and a total pressure of not less than 4.0 ata, with the relationship between the partial pressure p and the total pressure $P_t$ being $$10^P < P_t^{0.37} + \log_{10} 6$$

thereby obtaining sound ingots free of blowholes.

The above and other features of the present invention will become apparent from the following description made with reference to the drawings.

DETAILED DESCRIPTION OF THE PREFERRED EMBODIMENT

Figure 1:
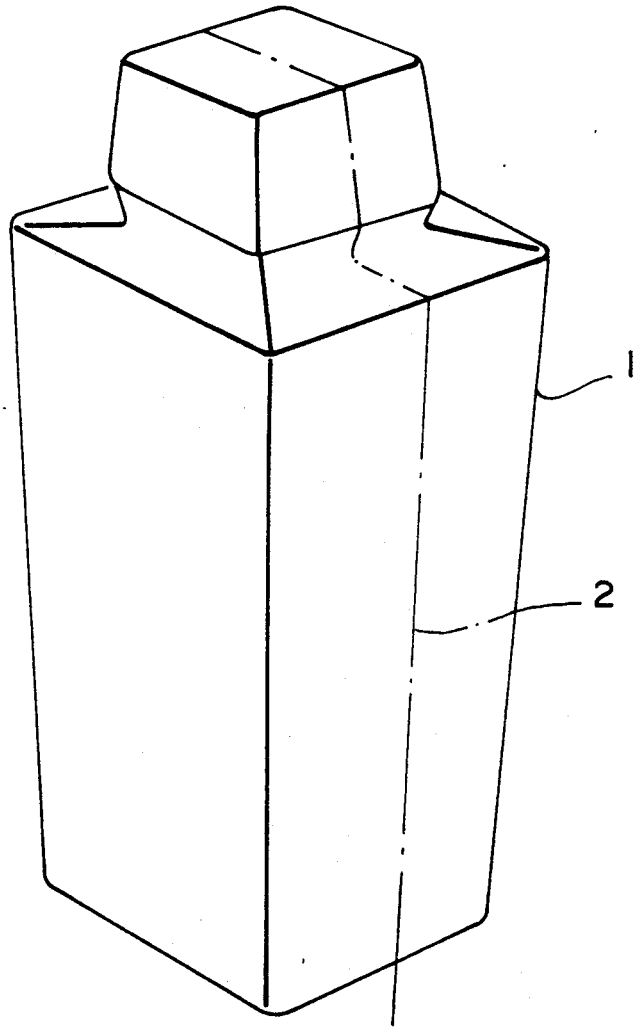
FIG. 1 is a perspective view of an ingot and the manner in which it is to be cut.

The reasons for the limits placed on the components of the high-nitrogen ferritic heat-resisting steel in this invention will now be explained.

C is required for achieving strength. Adequate strength cannot be achieved at a C content of less than 0.01%, while at a C content exceeding 0.30% the steel is strongly affected by welding heat and undergoes hardening which becomes a cause for low-temperature cracking. The C content range is therefore set at 0.01–0.30%.

Si is important for achieving oxidation resistance and is also required as a deoxidizing agent. It is insufficient for these purposes at a content of less than 0.02%, whereas a content exceeding 0.80% reduces the creep rupture strength. The Si content range is therefore set at 0.02–0.80%

Mn is required for deoxidation and also for achieving strength. It has to be added at at least 0.20% for adequately exhibiting its effect. When it exceeds 1.00% it may in some cases reduce creep rupture strength. The Mn content range is therefore set at 0.20–1.00%.

Cr is indispensable to oxidation resistance. It also contributes to increasing creep resistance by combining with N and finely precipitating in the base metal matrix in the form of $Cr_2N$, $Cr_2(C,N)$ and the like. Its lower limit is set at 8.0% from the viewpoint of oxidation resistance. Its upper limit is set at 13.0% for maintaining the Cr equivalent value at a low level so as to realize a martensite phase texture.

W produces a marked increase in creep rupture strength by solution hardening. Its effect toward increasing creep rupture strength over long periods at high temperatures of 550° C. and higher is particularly pronounced. Its upper limit is set at 3.00% because at contents higher than this level it precipitates in large quantities in the form of carbide and intermetallic compounds which sharply reduce the toughness of the base metal. The lower limit is set at 0.50% because it does not exhibit adequate solution hardening effect at lower levels.

Mo increases high-temperature strength through solution hardening. It does not exhibit adequate effect at a content of less than 0.005% and at a content higher than 1.00% it may, when added together with W, cause heavy precipitation of $Mo_2C$ type oxides which markedly reduce base metal toughness. The Mo content range is therefore set at 0.005–1.00%.

V produces a marked increase in the high-temperature strength of the steel regardless of whether it forms precipitates or, like W, enters solid solution in the matrix. When it precipitates, the resulting VN serves as precipitation nuclei for $Cr_2N$ and $Cr_2(C,N)$, which has a pronounced effect toward promoting fine dispersion of the precipitates. It has no effect at below 0.05% and reduces toughness at higher than 0.50%. The V content range is therefore set at 0.05–0.50%.

Nb increases high-temperature strength by precipitating as NbN and Nb(C,N). Also, similarly to V, it promotes fine precipitate dispersion by forming precipitation nuclei for $Cr_2$, $Cr_2(C,N)$ and the like. The lower limit at which it manifests these effects is 0.02%. Its upper limit is set at 0.12% because when present at higher levels it reduces strength by causing precipitate coagulation and enlargement.

N dissolves in the matrix and also forms nitride and carbo-nitride precipitates. As the form of the precipitates is mainly $Cr_2N$ and $Cr_2(C,N)$, there is less precipitate-induced consumption of Cr and W than in the case of the $M_{23}C_6$, $M_6C$ and other such precipitates observed in conventional steels. N thus increases oxidation resistance and creep rupture strength. At least 0.10% is required for precipitation of nitrides and carbo-nitrides and suppressing precipitation of $M_{23}C_6$, $M_6C$. The upper limit is set at 0.50% for preventing coagulation and enlargement of nitride and carbo-nitride precipitates by the presence of excessive nitrogen.

P, S and O are present in the steel according to this invention as impurities. P and S hinder the achievement of the purpose of the invention by lowering strength, while O has the adverse effect of forming oxides which reduce toughness. The upper limits on these elements is therefore set at 0.050%, 0.010% and 0.020%, respectively.

The basic components of the steel according to this invention (aside from Fe) are as set out above. Depending on the purpose to which the steel is to be put, however, it may additionally contain (A) one or both of 0.01–1.00% Ta and 0.01–1.00% Hf and/or (B) one or both of 0.0005–0.10% Zr and 0.01–0.10% Ti.

At low concentrations Ta and Hf act as deoxidizing agents. At high concentrations they form fine high melting point nitrides and carbo-nitrides and, as such, increase toughness by decreasing the austenite grain size. In addition, they also reduce the degree to which Cr and W dissolve in precipitates and by this effect enhance the effect of supersaturation with nitrogen. Neither element exhibits any effect at less than 0.01%. When either is present at greater than 1.00%, it reduces toughness by causing enlargement of nitride and carbonitride precipitates. The content range of each of these elements is therefore set at 0.01–1.00%.

Acting to govern the deoxidation equilibrium in the steel, Zr suppresses the formation of oxides by markedly reducing the amount of oxygen activity. In addition, its strong affinity for N promotes precipitation of fine nitrides and carbo-nitrides which increase creep rupture strength and high-temperature oxidation resistance. When present at less than 0.0005% it does not provide an adequate effect of governing the deoxidation equilibrium, and when present at greater than 0.10% it results in heavy precipitation of coarse ZrN and ZrC which markedly reduce the toughness of the base metal. The Zr content range is therefore set at 0.0005–0.10%.

Ti raises the effect of excess nitrogen by precipitating in the form of nitrides and carbo-nitrides. At a content of less than 0.01% it has no effect, while at a content of over 0.10% it results in precipitation of coarse nitrides and carbo-nitrides which reduce toughness. The Ti content range is therefore set at 0.01–0.10%.

The aforesaid alloying components can be added individually or in combinations.

The object of this invention is to provide a ferritic heat-resisting steel that is superior in creep rupture strength and high-temperature oxidation resistance. Depending on the purpose of use it can be produced by various methods and be subjected to various types of heat treatment. These methods and treatments in no way diminish the effect of the invention.

However, in view of the need to supersaturate the steel with nitrogen, it is necessary during casting to raise the pressure of the atmosphere to not less than 4.0 ata and to control the nitrogen partial pressure to not less than 1.0 ata. As an auxiliary gas to be mixed with the nitrogen gas it is appropriate to use an inert gas such as Ar, Ne, Xe or Kr. These casting conditions were determined by the following experiment.

Steel of a chemical composition aside from nitrogen as indicated in claims 1–4 was melted in an induction heating furnace installed in a chamber that could be pressurized up to 150 ata. A mixed gas of argon and nitrogen having a prescribed nitrogen partial pressure was introduced into the furnace and maintained at a pressure which was varied from test to test. After the nitrogen and molten metal had reached chemical equilibrium, the molten metal was cast into a mold that had been installed in the chamber beforehand, whereby there was obtained a 5-ton ingot.

The ingot was cut vertically as shown in FIG. 1 and the ingot 1 was visually examined for the presence of blowholes.

Following this examination, a part of the ingot was placed in a furnace and maintained at 1180° C. for 1 hour and then forged into a plate measuring 50 mm in thickness, 750 mm in width and 4,000 mm in length.

This plate was subjected to solution treatment at 1100° C. for 1 hour and to tempering at 760° C. for 3 hours. The steel was then chemically analyzed and the dispersion state and morphology of the nitrides and carbo-nitrides were investigated by observation with an optical microscope, an electron microscope, X-ray diffraction and electron beam diffraction, whereby the chemical structure was determined.

Figure 2:
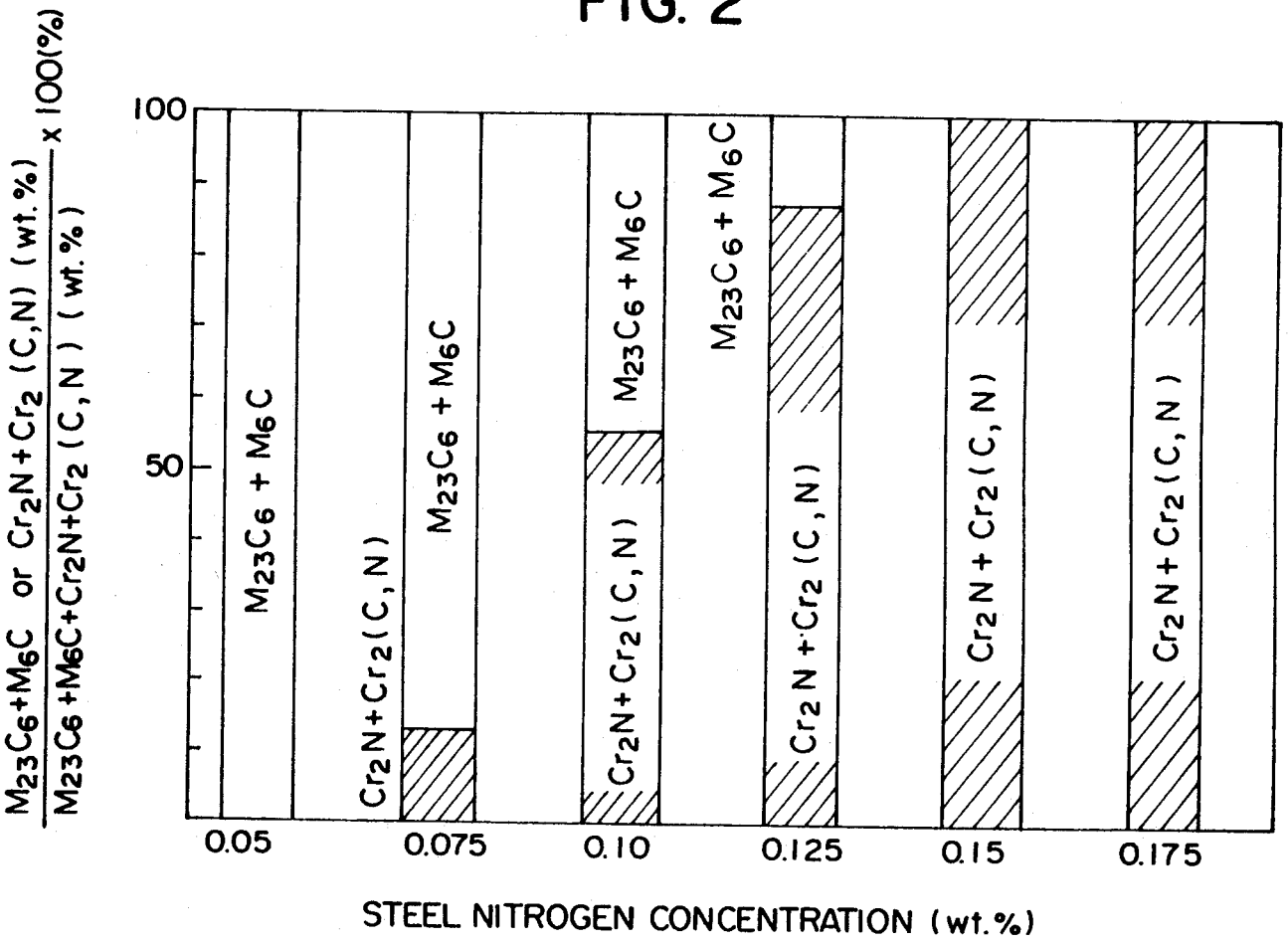
FIG. 2 is a graph showing the relationship between the steel nitrogen content and the weight percentage of the total of $M_{23}C_6+M_6C+Cr_2N+Cr_2(C,N)$ among the precipitates in the steel accounted for by $M_{23}C_6+M_6C$, and the relationship between the steel nitrogen content and the weight percentage of the total of $M_{23}C_6+M_6C+Cr_2N+Cr_2(C,N)$ among the precipitates in the steel accounted for by $Cr_2N+Cr_2(C,N)$.

Among the precipitates present within the as-heat-treated steel, FIG. 2 shows how the proportion of the precipitates in the steel accounted for by $M_{23}C_6$ type carbides and $M_6C$ type carbides, and the proportion thereof accounted for by $Cr_2N$ type nitrides and carbo-nitrides, vary with nitrogen concentration. At a nitrogen concentration of 0.1%, nitrides and carbo-nitrides account for the majority of the precipitates in the steel, while at a nitrogen concentration of 0.15%, substantially 100% of the precipitates are nitrides and carbo-nitrides with virtually no carbides present whatsoever. Thus, for the effect of this invention to be adequately manifested it is necessary for the nitrogen concentration of the steel to be not less than 0.1%.

Figure 3:
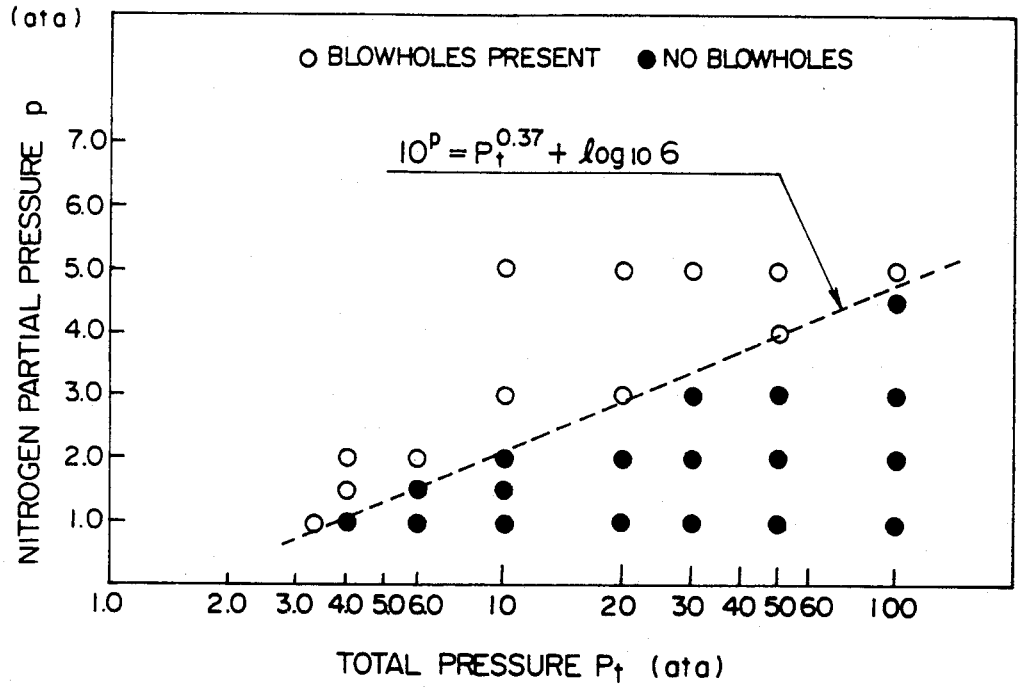
FIG. 3 is a graph showing conditions under which blowholes occur in the ingot in terms of the relationship between the total pressure and nitrogen partial pressure of the atmosphere during casting.

The graph of FIG. 3 shows how the state of blowhole occurrence varies depending on the relationship between the total and nitrogen partial pressure of the atmosphere. For achieving a nitrogen concentration of 0.1% or higher it is necessary to use a total pressure of not less than 4.0 ata. Equilibrium calculation based on Sievert's law shows that the nitrogen partial pressure in this case is not less than 1.0 ata.

Moreover, where for controlling the amount of nitride and carbo-nitride precipitation the nitrogen partial pressure p is maintained at 1.0–6.0 ata (nitrogen concentration within the steel of approximately 0.5 wt. %), it becomes necessary to vary the total pressure $P_t$ between 4.0 and about 100 ata, the actual value selected depending on the nitrogen partial pressure. Namely, it is necessary to use a total pressure falling above the broken line representing the boundary pressure in FIG. 3.

When the boundary line of FIG. 3 is determined experimentally it is found to lie at $$10^P = P_t^{0.37} + \log_{10} 6$$

meaning that the steel according to this invention can be obtained by selecting an atmosphere of a pressure and composition meeting the condition of the inequality $$10^P < P_t^{0.337} + \log_{10} 6.$$

It is therefore necessary to use furnace equipment enabling pressure and atmosphere control. Without such equipment, it is difficult to produce the steel of the present invention.

There are no limitations whatever on the melting method. Based on the chemical composition of the steel and cost considerations, it suffices to select from among processes using a converter, an induction heating furnace, an arc melting furnace or an electric furnace.

The situation regarding refining is similar. Insofar as the atmosphere is controlled to a total pressure of not less than 4.0 ata and a nitrogen partial pressure of not less than 1.0 ata, it is both possible and effective to use a ladle furnace, an electro-slag remelting furnace or a zone melting furnace.

After casting under a pressurized atmosphere of a total pressure of not less than 4.0 ata and a nitrogen partial pressure of not less than 1.0 ata, it is possible to process the steel into a billet, bloom or plate by casting or hot rolling. Since the steel of this invention includes finely dispersed nitrides and carbo-nitrides, it is superior to conventional ferritic heat-resisting steels in hot-workability. This is also one reason for employing nitrides and carbo-nitrides obtained by adding nitrogen to beyond the solution limit.

For processing the steel into products, it is possible to first process it into a round or rectangular billet and then form it into a seamless pipe or tube by hot extrusion or any of various seamless rolling methods. Otherwise it can be formed into a sheet by hot and cold rolling and then made into a welded tube by electric resistance welding. Alternatively, it can be processed into a welded pipe or tube by use of TIG, MIG, SAW, LASER and EB welding, individually or in combination. Moreover, it is possible to expand the size range of products to which the present invention can be applied by following any of the aforesaid processes by hot or warm stretch reduction or sizing.

The steel according to the invention can also be provided in the form of a plate or sheet. The plate or sheet can, in its hot-rolled state or after whatever heat treatment is found necessary, be provided as a heat-resisting material in various shapes, without any influence on the effects provided by the invention.

The pipe, tube, plate, sheet and variously shaped heat-resisting materials referred to above can, in accordance with their purpose and application, be subjected to various heat treatments, and it is important for them to be so treated for realizing the full effect of the invention.

While the production process ordinarily involves normalizing (solution heat treatment) +tempering, it is also possible and useful additionally to carry out one or a combination of two or more of quenching, tempering and normalizing. It is also possible, without influencing the effects of the present invention in any way, to repeatedly carry out one or more of the aforesaid processes to whatever degree is necessary for adequately bringing out the steel properties.

The aforesaid processes can be appropriately selected and applied to the manufacture of the steel according to the invention.

WORKING EXAMPLES

The steels indicated in Tables 1–4, each having a composition according to one of claims 1–4, were separately melted in amounts of 5 tons each in an induction heating furnace provided with pressurizing equipment. The resulting melt was cleaned by ladle furnace processing (under bubbling with a gas of the same composition as the atmosphere) for reducing its impurity content, whereafter the atmosphere was regulated using a mixed gas of nitrogen and argon so as to satisfy the conditions of the inequality shown above. The melt was then cast into a mold and processed into a round billet, part of which was hot extruded to obtain a tube 60 mm in diameter and 10 mm in wall thickness and the remainder of which was subjected to seamless rolling to obtain a pipe 380 mm in diameter and 50 mm in wall thickness. The tube and pipe were subjected to a single normalization at 1100° C. for 1 hour and were then tempered at 760° C. for 3 hours.

In addition, a 50 ton ingot was cast and forged into a slab which was hot rolled into 25 mm and 50 mm thick plates.

Figure 4:
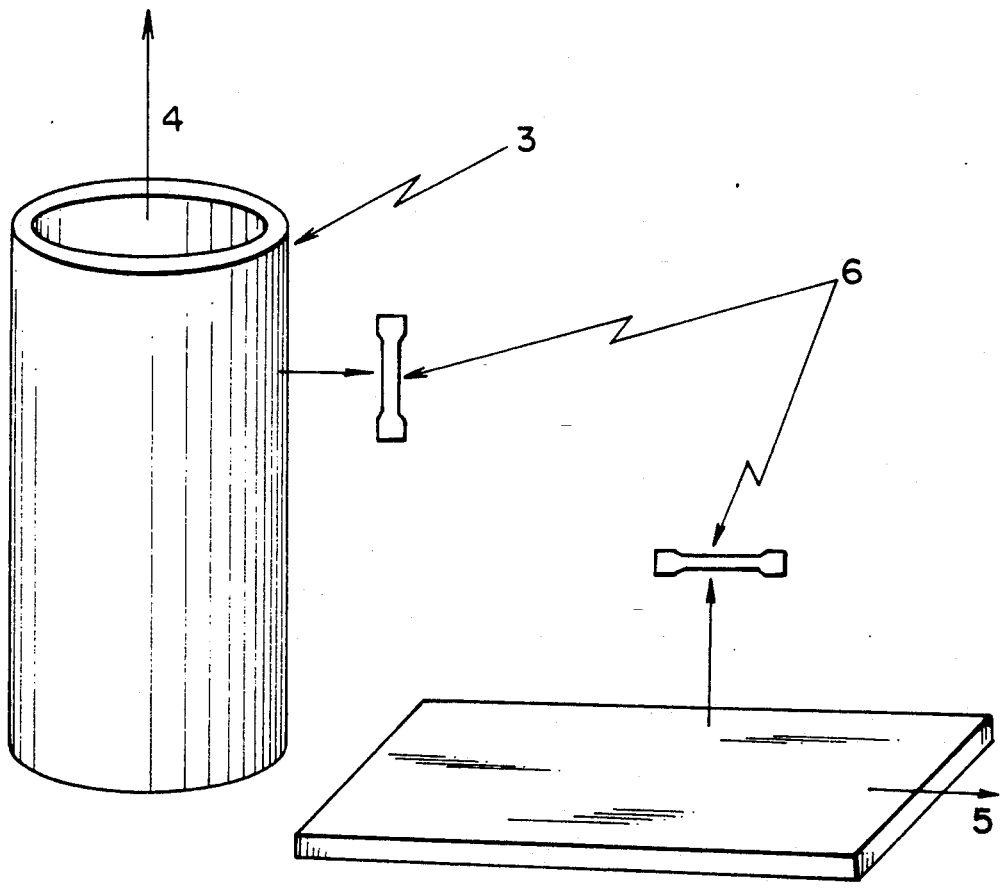
FIG. 4 is a perspective view showing the manner in which creep test pieces are taken from a pipe specimen and a rolled plate specimen.

As shown in FIG. 4, creep test pieces 6 measuring 6 mm in diameter were taken along the axial direction 4 of the pipe or tube 3 and along the rolling direction 5 of the plates and subjected to creep test measurement at 650° C. Based on the data obtained, a linear extrapolation was made for estimating the creep rupture strength at 150 thousand hours. A creep rupture strength of 15.0 kg/mm$^2$ was used as the creep rupture strength evaluation reference value. The creep rupture strength at 650° C., 150 thousand hours is hereinafter defined as the linearly extrapolated value at 150 thousand hours on the creep rupture strength vs rupture time graph.

Toughness was evaluated through an accelerated evaluation test in which aging was carried out at 700° C. for 10 thousand hours. JIS No. 4 tension test pieces were cut from the aged steel and evaluated for impact absorption energy. Assuming a water pressure test at 0° C., the toughness evaluation reference value was set at 5.0 kgf.m.

High-temperature oxidation resistance was evaluated by suspending a 25 mm×25 mm×5 mm test piece cut from the steel in 650° C. atmospheric air in a furnace for 10 thousand hours and then cutting the test piece parallel to the direction of growth of the scale and measuring the oxidation scale thickness.

The 650° C., 150 thousand hour creep rupture strength, the Charpy impact absorption energy at 0° C. after aging at 700° C. for 10 thousand hours and the oxidation scale thickness after oxidation at 650° C. for 10 thousand hours are shown in Tables 1 to 4, respectively.

For comparison, steels of compositions not falling within any of the claims 1 to 4 were melted, processed and tested in the same way as described above. Their chemical compositions and the evaluation results are shown in Table 5.

Figure 5:
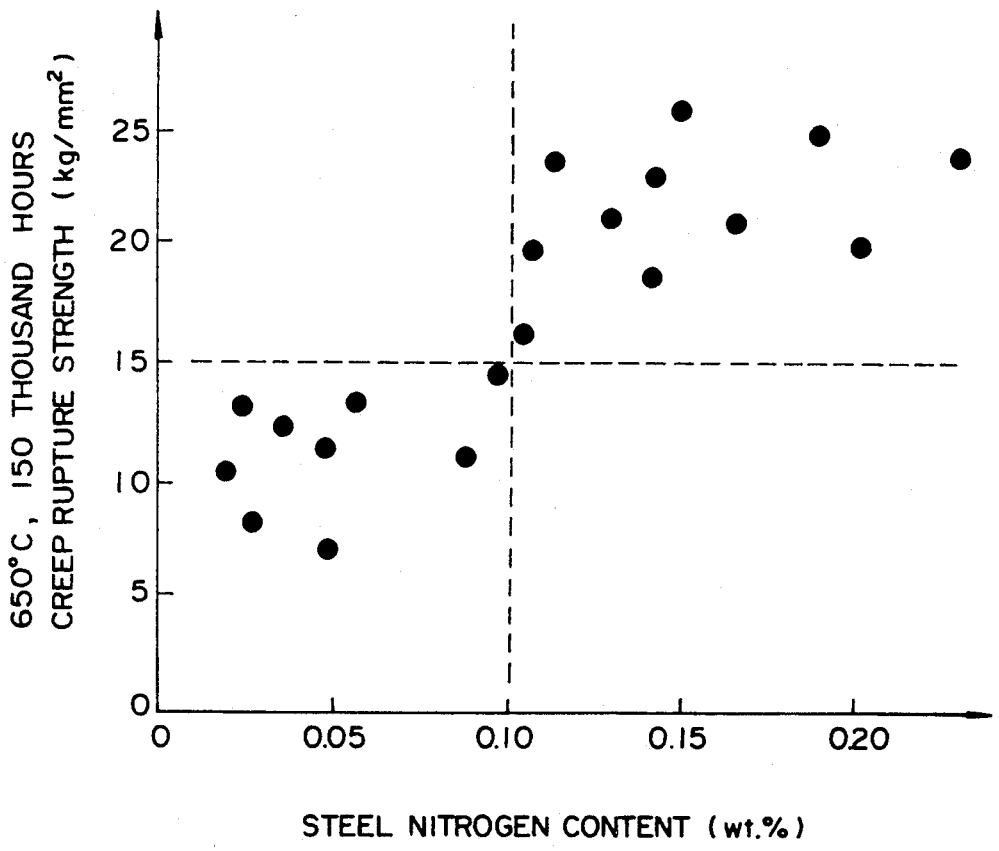
FIG. 5 is a graph showing the relationship between steel nitrogen content and extrapolated creep rupture strength at 650° C., 150 thousand hours.

FIG. 5 shows the relationship between the nitrogen content of the steels and the extrapolated creep rupture strength at 650° C., 150 thousand hours. It will be noted that the creep rupture strength attains high values exceeding 15 kg/mm$^2$ at a steel nitrogen content of 0.1% or higher but falls below 15 kg/mm$^2$ and fails to satisfy the evaluation reference value that was set at a steel nitrogen content of less than 0.1%.

Figure 6:
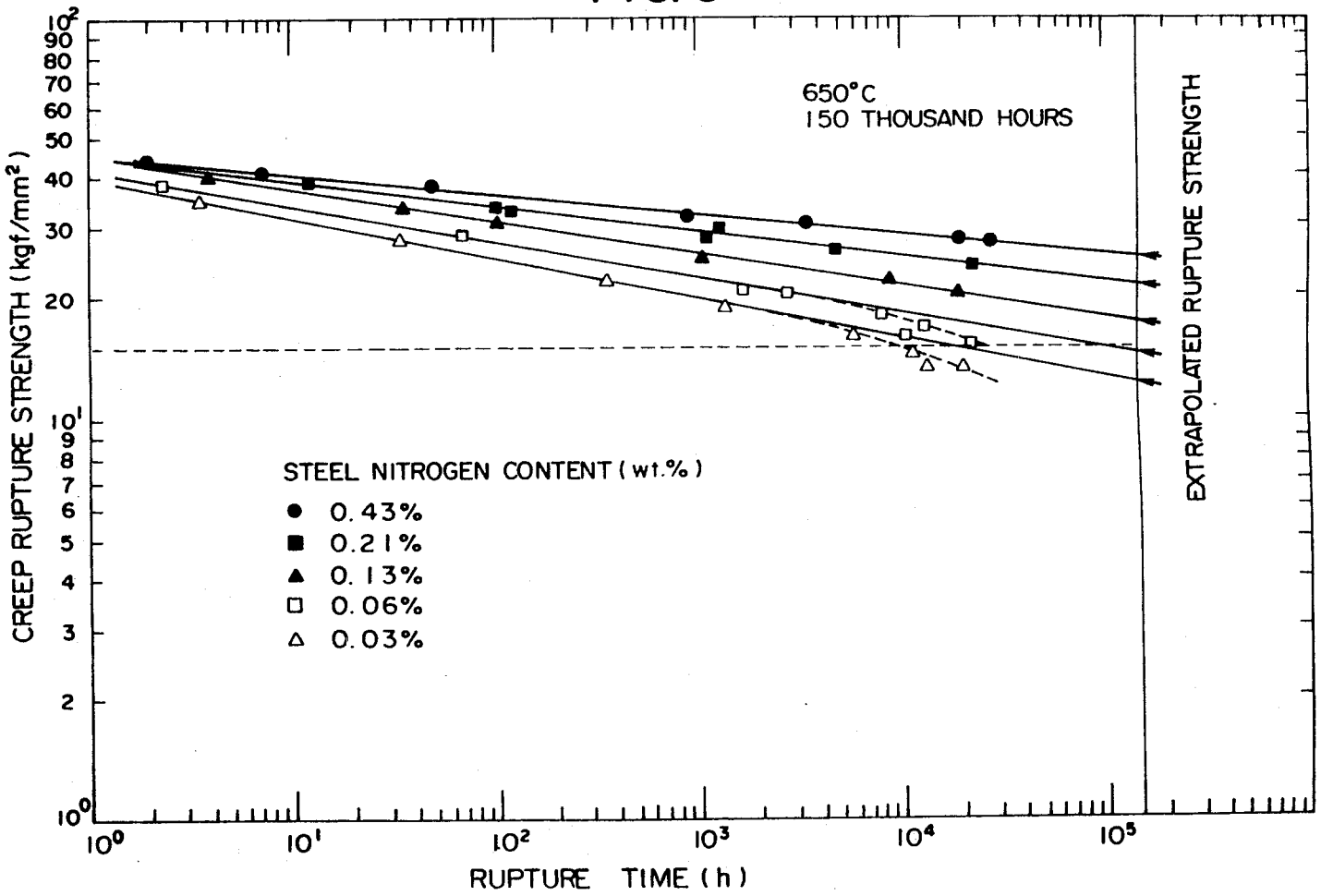
FIG. 6 is a graph showing an example of creep test results in terms of stress vs rupture time.

FIG. 6 shows the results of the creep test in terms of stress vs rupture time. A good linear relationship can be noted between stress and rupture time at a steel nitrogen content of not less than 0.1%. On the other hand, when the steel nitrogen content falls below 0.1%, the relationship between stress and rupture time exhibits a pronounced decline in creep rupture strength with increasing time lapse. That is to say, linearity is not maintained. This is because W and the other solution hardening elements precipitate as carbides whose coagulation and enlargement degrades the creep rupture strength property of the base metal. In contrast, at a nitrogen content of 0.1% or higher, fine nitrides and carbo-nitrides are preferentially precipitated so that the formation of carbides is greatly delayed, and since this suppresses the dissolution of the solution hardening elements into carbides, a high creep rupture strength was maintained in the long-term creep test.

Figure 7:
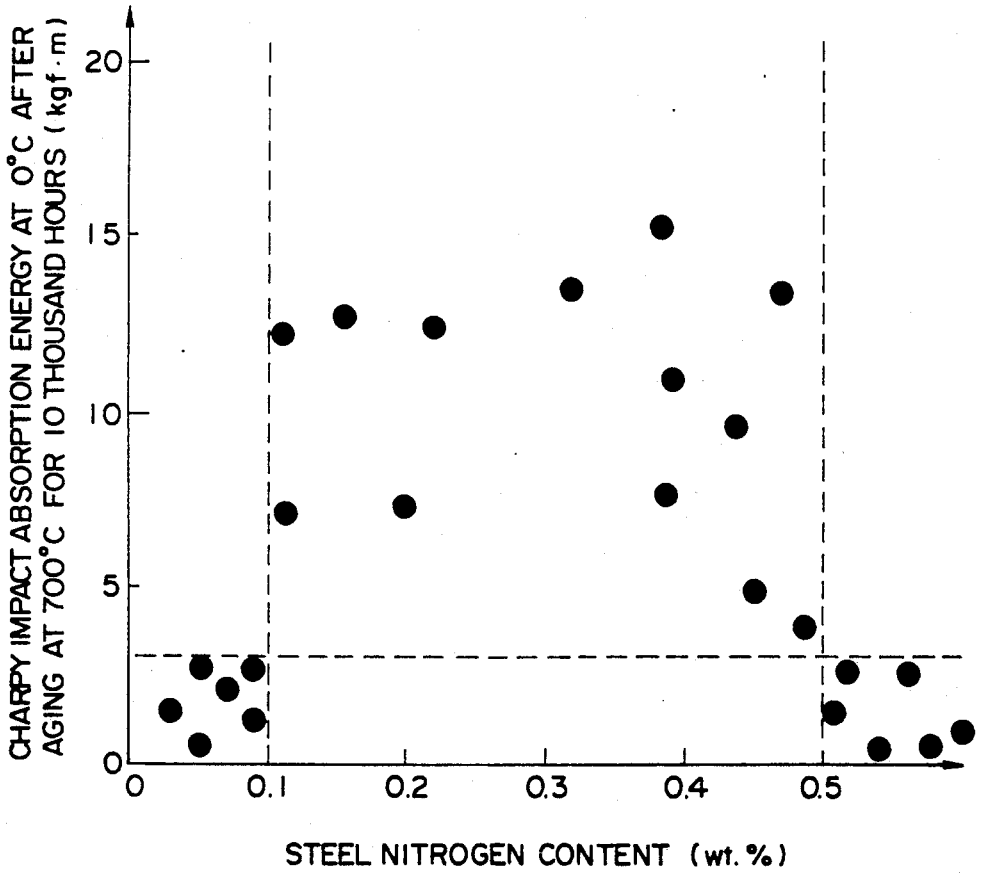
FIG. 7 is a graph showing the relationship between steel nitrogen content and Charpy impact absorption energy at 0° C. following aging at 700° C. for 10 thousand hours.

FIG. 7 shows the relationship between Charpy impact absorption energy at 0° C. following aging at 700° C. for 10 thousand hours and steel nitrogen content. When the steel nitrogen content falls within the range of 0.1–0.5%, the impact absorption energy exceeds 3.0 kgf.m. In contrast, when it falls below 0.1%, there is little or no suppression of grain growth by residual high melting point nitrides during solution treatment and, as a result, the impact absorption energy decreases, and when it exceeds 0.5%, the impact absorption energy is reduced by heavy nitride precipitation.

Figure 8:
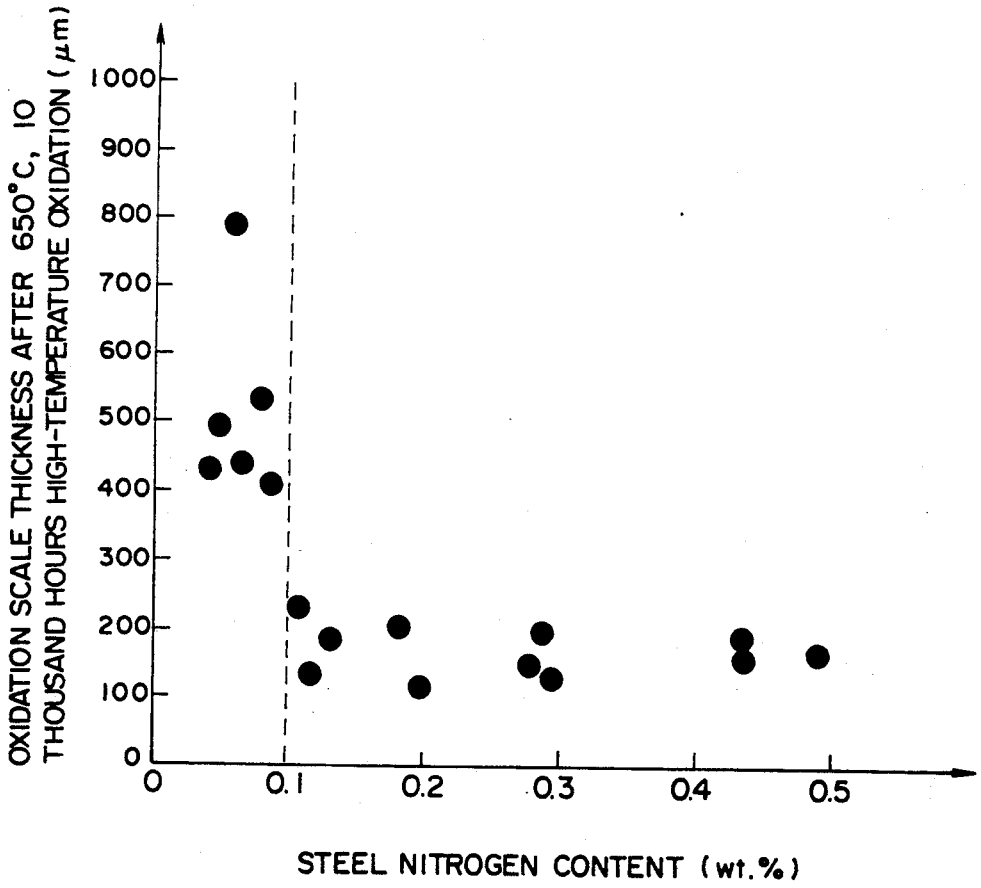
FIG. 8 is a graph showing the relationship between steel nitrogen content and the thickness of the oxidation scale formed on the surface of a test piece after oxidation at 650° C. for 10 thousand hours.

FIG. 8 shows the relationship between the thickness of the oxidation scale formed on the surface of a test piece after oxidation at 650 C for 10 thousand hours and the steel nitrogen content. Although the oxidation scale thickness is between 400 and 800 μm when the steel nitrogen content falls below 0.1%, it decreases to 250 μm or less when the steel nitrogen content is 0.1% or higher.

Reference is now made to the comparison steels shown in Table 5. Nos. 161 and 162 are examples in which insufficient steel nitrogen content resulted in a low extrapolated creep rupture strength at 650° C., 150 thousand hours, and also poor high-temperature oxidation resistance. Nos. 163 and 164 are examples in which excessive steel nitrogen content caused heavy precipitation of coarse nitrides and carbo-nitrides, resulting in a Charpy impact absorption energy at 0° C. after aging at 700° C. for 10 thousand hours of not more than 3.0 kgf.m. No. 165 is an example in which a low W concentration resulted in a low creep rupture strength owing to insufficient solution hardening, notwithstanding that the steel nitrogen content fell within the range of the invention. No. 166 is an example in which heavy precipitation of coarse ZrN caused by a Zr concentration in excess of 0.1% resulted in a Charpy impact absorption energy at 0° C. after aging at 700° C. for 10 thousand hours of less than 3.0 kgf.m. Nos. 167, 168 and 169 are examples similar to the case of No. 166 except that the elements present in excess were Ta, Hf and Ti, respectively. As a result, heavy precipitation of coarse TaN, HfN and TiN resulted in a Charpy impact absorption energy at 0° C. after aging at 700° C. for 10 thousand hours of less than 3.0 kgf.m. No. 170 is an example in which the nitrogen partial pressure was 2.2 ata and the total pressure was 2.5 ata, values not satisfying the inequality set forth above, so that many large blowholes formed in the ingot, making it impossible to obtain either a sound ingot or a plate, and leading to a reduction in both the extrapolated creep rupture strength at 650° C., 150 thousand hours and the Charpy impact absorption energy at 0° C. after aging at 700° C. for 10 thousand hours.

TABLE 1

| | (Wt. %) Invention Steels | | | | | | | | | | | | | | | | | | |
|---|---|---|---|---|---|---|---|---|---|---|---|---|---|---|---|---|---|---|---|
| No. | C | Si | Mn | P | S | Nb | V | Cr | Mo | W | Zr | Ta | Hf | Ti | N | O | CS kg/mm² | VE kgf · m | TO μm |
| 1 | 0.018 | 0.682 | 0.885 | 0.034 | 0.009 | 0.058 | 0.215 | 11.98 | 0.922 | 0.850 | — | — | — | — | 0.255 | 0.019 | 19.9 | 4.67 | 176 |
| 2 | 0.131 | 0.796 | 0.532 | 0.029 | 0.002 | 0.074 | 0.490 | 8.77 | 0.961 | 1.024 | — | — | — | — | 0.104 | 0.010 | 16.0 | 13.9 | 117 |
| 3 | 0.255 | 0.685 | 0.935 | 0.014 | 0.009 | 0.046 | 0.382 | 11.45 | 0.421 | 2.157 | — | — | — | — | 0.143 | 0.004 | 17.3 | 12.8 | 206 |
| 4 | 0.011 | 0.499 | 0.249 | 0.019 | 0.009 | 0.094 | 0.432 | 11.00 | 0.985 | 2.256 | — | — | — | — | 0.250 | 0.007 | 21.0 | 4.24 | 175 |
| 5 | 0.035 | 0.387 | 0.626 | 0.029 | 0.007 | 0.084 | 0.269 | 8.36 | 0.350 | 1.752 | — | — | — | — | 0.301 | 0.003 | 23.5 | 4.40 | 198 |
| 6 | 0.088 | 0.491 | 0.213 | 0.013 | 0.002 | 0.037 | 0.202 | 9.46 | 0.193 | 1.124 | — | — | — | — | 0.170 | 0.014 | 17.0 | 16.0 | 230 |
| 7 | 0.226 | 0.566 | 0.756 | 0.038 | 0.008 | 0.072 | 0.091 | 12.71 | 0.698 | 0.829 | — | — | — | — | 0.329 | 0.016 | 23.4 | 7.19 | 226 |
| 8 | 0.074 | 0.763 | 0.813 | 0.012 | 0.009 | 0.105 | 0.470 | 9.07 | 0.563 | 2.597 | — | — | — | — | 0.259 | 0.012 | 24.2 | 14.8 | 135 |
| 9 | 0.110 | 0.056 | 0.530 | 0.022 | 0.002 | 0.057 | 0.302 | 12.02 | 0.479 | 0.656 | — | — | — | — | 0.430 | 0.015 | 21.7 | 6.95 | 212 |
| 10 | 0.250 | 0.151 | 0.857 | 0.016 | 0.003 | 0.096 | 0.116 | 12.42 | 0.617 | 2.967 | — | — | — | — | 0.117 | 0.009 | 22.6 | 14.2 | 113 |
| 11 | 0.260 | 0.418 | 0.748 | 0.021 | 0.004 | 0.041 | 0.452 | 11.29 | 0.686 | 2.505 | 0.0429 | — | — | — | 0.400 | 0.018 | 23.7 | 4.09 | 236 |
| 12 | 0.046 | 0.599 | 0.739 | 0.024 | 0.006 | 0.061 | 0.263 | 11.94 | 0.846 | 0.961 | 0.0253 | — | — | — | 0.146 | 0.015 | 17.1 | 14.2 | 163 |
| 13 | 0.098 | 0.465 | 0.593 | 0.033 | 0.008 | 0.025 | 0.312 | 12.92 | 0.306 | 2.574 | 0.0249 | — | — | — | 0.435 | 0.007 | 24.5 | 5.48 | 221 |
| 14 | 0.183 | 0.560 | 0.469 | 0.017 | 0.001 | 0.101 | 0.238 | 12.70 | 0.257 | 1.592 | 0.0595 | — | — | — | 0.149 | 0.012 | 17.7 | 8.16 | 138 |
| 15 | 0.062 | 0.615 | 0.891 | 0.021 | 0.006 | 0.057 | 0.340 | 12.06 | 0.365 | 2.174 | 0.0488 | — | — | — | 0.349 | 0.018 | 23.8 | 11.0 | 166 |
| 16 | 0.224 | 0.791 | 0.425 | 0.034 | 0.006 | 0.113 | 0.483 | 12.05 | 0.827 | 2.318 | 0.0113 | — | — | — | 0.118 | 0.018 | 24.5 | 16.6 | 184 |
| 17 | 0.146 | 0.458 | 0.829 | 0.023 | 0.002 | 0.038 | 0.080 | 8.63 | 0.346 | 1.264 | 0.0155 | — | — | — | 0.129 | 0.016 | 16.7 | 13.6 | 221 |
| 18 | 0.171 | 0.531 | 0.633 | 0.035 | 0.006 | 0.050 | 0.331 | 12.67 | 0.584 | 1.931 | 0.0299 | — | — | — | 0.256 | 0.015 | 22.3 | 4.85 | 230 |
| 19 | 0.065 | 0.385 | 0.401 | 0.019 | 0.001 | 0.117 | 0.431 | 12.63 | 0.749 | 2.345 | 0.0735 | — | — | — | 0.178 | 0.009 | 18.2 | 13.5 | 162 |
| 20 | 0.169 | 0.161 | 0.275 | 0.041 | 0.007 | 0.110 | 0.233 | 9.43 | 0.515 | 1.688 | 0.0166 | — | — | — | 0.365 | 0.011 | 21.3 | 7.73 | 122 |
| 21 | 0.250 | 0.394 | 0.807 | 0.010 | 0.002 | 0.096 | 0.269 | 11.51 | 0.570 | 1.668 | — | 0.014 | — | — | 0.293 | 0.015 | 18.4 | 3.71 | 213 |
| 22 | 0.072 | 0.070 | 0.554 | 0.032 | 0.008 | 0.094 | 0.405 | 12.37 | 0.116 | 1.542 | — | 0.346 | — | — | 0.442 | 0.016 | 21.4 | 11.3 | 164 |
| 23 | 0.126 | 0.110 | 0.459 | 0.035 | 0.002 | 0.021 | 0.270 | 10.37 | 0.319 | 1.731 | — | 0.645 | — | — | 0.484 | 0.017 | 22.0 | 11.8 | 224 |
| 24 | 0.023 | 0.257 | 0.268 | 0.047 | 0.010 | 0.100 | 0.175 | 11.45 | 0.878 | 1.502 | — | 0.443 | — | — | 0.488 | 0.011 | 22.5 | 15.3 | 201 |
| 25 | 0.118 | 0.292 | 0.545 | 0.035 | 0.009 | 0.097 | 0.432 | 11.62 | 0.986 | 1.305 | — | 0.146 | — | — | 0.138 | 0.004 | 19.4 | 3.31 | 196 |
| 26 | 0.028 | 0.343 | 0.627 | 0.046 | 0.002 | 0.081 | 0.224 | 9.26 | 0.330 | 2.857 | — | 0.356 | — | — | 0.104 | 0.016 | 19.8 | 13.3 | 164 |
| 27 | 0.240 | 0.568 | 0.675 | 0.029 | 0.001 | 0.072 | 0.085 | 10.36 | 0.591 | 1.629 | — | 0.074 | — | — | 0.468 | 0.005 | 15.5 | 13.0 | 130 |
| 28 | 0.229 | 0.721 | 0.837 | 0.030 | 0.010 | 0.086 | 0.327 | 8.33 | 0.465 | 1.848 | — | 0.372 | — | — | 0.297 | 0.011 | 18.3 | 12.0 | 124 |
| 29 | 0.050 | 0.546 | 0.848 | 0.038 | 0.004 | 0.095 | 0.354 | 11.53 | 0.619 | 2.724 | — | 0.034 | — | — | 0.465 | 0.011 | 15.2 | 5.99 | 250 |
| 30 | 0.047 | 0.599 | 0.883 | 0.019 | 0.008 | 0.116 | 0.256 | 8.56 | 0.269 | 2.234 | — | 0.247 | — | — | 0.458 | 0.007 | 17.9 | 4.49 | 234 |
| 31 | 0.274 | 0.224 | 0.265 | 0.021 | 0.001 | 0.067 | 0.335 | 10.15 | 0.076 | 0.809 | 0.0179 | 0.129 | — | — | 0.138 | 0.011 | 18.5 | 3.06 | 179 |
| 32 | 0.059 | 0.358 | 0.757 | 0.032 | 0.003 | 0.067 | 0.452 | 12.38 | 0.237 | 2.678 | 0.0490 | 0.376 | — | — | 0.384 | 0.010 | 18.6 | 11.3 | 114 |
| 33 | 0.181 | 0.371 | 0.509 | 0.019 | 0.001 | 0.086 | 0.250 | 8.67 | 0.445 | 0.876 | 0.0223 | 0.251 | — | — | 0.273 | 0.016 | 20.1 | 11.1 | 217 |
| 34 | 0.262 | 0.399 | 0.868 | 0.029 | 0.002 | 0.043 | 0.253 | 9.91 | 0.378 | 0.786 | 0.0571 | 0.459 | — | — | 0.477 | 0.005 | 20.3 | 12.1 | 143 |

TABLE 1-continued (Wt. %) Invention Steels

| No. | C | Si | Mn | P | S | Nb | V | Cr | Mo | W | Zr | Ta | Hf | Ti | N | O | CS kg/mm² | VE kgf · m | TO μm |
|---|---|---|---|---|---|---|---|---|---|---|---|---|---|---|---|---|---|---|---|
| 35 | 0.214 | 0.216 | 0.397 | 0.011 | 0.003 | 0.106 | 0.102 | 12.12 | 0.740 | 1.685 | 0.0217 | 0.012 | — | — | 0.479 | 0.007 | 20.8 | 16.7 | 144 |
| 36 | 0.088 | 0.739 | 0.842 | 0.031 | 0.007 | 0.044 | 0.111 | 8.72 | 0.216 | 1.550 | 0.0349 | 0.220 | — | — | 0.350 | 0.018 | 23.5 | 6.79 | 248 |
| 37 | 0.086 | 0.551 | 0.737 | 0.018 | 0.004 | 0.025 | 0.126 | 8.08 | 0.972 | 2.042 | 0.0139 | 0.135 | — | — | 0.162 | 0.003 | 15.0 | 12.5 | 107 |
| 38 | 0.256 | 0.183 | 0.243 | 0.038 | 0.002 | 0.068 | 0.466 | 8.69 | 0.221 | 2.419 | 0.0778 | 0.042 | — | — | 0.389 | 0.003 | 17.5 | 15.8 | 198 |
| 39 | 0.219 | 0.572 | 0.708 | 0.019 | 0.002 | 0.042 | 0.085 | 8.95 | 0.629 | 1.881 | 0.0474 | 0.893 | — | — | 0.109 | 0.012 | 17.8 | 12.4 | 179 |
| 40 | 0.179 | 0.303 | 0.684 | 0.049 | 0.003 | 0.115 | 0.420 | 9.82 | 0.894 | 2.155 | 0.0889 | 0.370 | — | — | 0.199 | 0.006 | 22.7 | 4.69 | 222 |
| 41 | 0.187 | 0.297 | 0.323 | 0.035 | 0.009 | 0.058 | 0.205 | 9.76 | 0.207 | 1.210 | — | — | 0.065 | — | 0.329 | 0.006 | 19.2 | 9.50 | 136 |
| 42 | 0.010 | 0.703 | 0.969 | 0.025 | 0.009 | 0.088 | 0.427 | 12.17 | 0.252 | 0.775 | — | — | 0.215 | — | 0.377 | 0.009 | 19.2 | 8.48 | 247 |
| 43 | 0.138 | 0.506 | 0.381 | 0.046 | 0.004 | 0.074 | 0.269 | 10.54 | 0.220 | 1.320 | — | — | 0.456 | — | 0.422 | 0.006 | 19.4 | 4.07 | 207 |
| 44 | 0.041 | 0.617 | 0.703 | 0.026 | 0.006 | 0.034 | 0.265 | 8.26 | 0.792 | 2.052 | — | — | 0.971 | — | 0.332 | 0.002 | 21.8 | 12.9 | 120 |
| 45 | 0.068 | 0.413 | 0.885 | 0.012 | 0.007 | 0.087 | 0.270 | 8.76 | 0.159 | 2.161 | — | — | 0.946 | — | 0.187 | 0.019 | 18.1 | 16.5 | 236 |
| 46 | 0.120 | 0.416 | 0.665 | 0.010 | 0.004 | 0.052 | 0.143 | 10.44 | 0.989 | 0.894 | — | — | 0.574 | — | 0.254 | 0.014 | 15.2 | 3.72 | 136 |
| 47 | 0.257 | 0.393 | 0.211 | 0.010 | 0.008 | 0.098 | 0.430 | 9.35 | 0.506 | 1.243 | — | — | 0.547 | — | 0.211 | 0.018 | 15.3 | 5.21 | 225 |
| 48 | 0.247 | 0.102 | 0.467 | 0.039 | 0.002 | 0.095 | 0.304 | 11.36 | 0.871 | 1.153 | — | — | 0.555 | — | 0.140 | 0.007 | 20.1 | 16.5 | 155 |
| 49 | 0.287 | 0.086 | 0.393 | 0.045 | 0.002 | 0.061 | 0.306 | 12.46 | 0.296 | 1.104 | — | — | 0.781 | — | 0.115 | 0.012 | 16.4 | 5.38 | 178 |
| 50 | 0.287 | 0.092 | 0.929 | 0.014 | 0.005 | 0.064 | 0.297 | 11.05 | 0.946 | 2.816 | — | — | 0.908 | — | 0.208 | 0.009 | 21.1 | 9.21 | 247 |

CS: Creep rupture strength at 650° C., 150 thousand hours
VE: Charpy absorption energy at 0° C. after aging at 700° C. for 10 thousand hours
TO: Oxidation scale thickness after oxidation at 650° C. for 10 thousand hours in air

TABLE 2

(Wt. %) Invention Steels

| No. | C | Si | Mn | P | S | Nb | V | Cr | Mo | W | Zr | Ta | Hf | Ti | N | O | CS kg/mm² | VE kgf · m | TO μm |
|---|---|---|---|---|---|---|---|---|---|---|---|---|---|---|---|---|---|---|---|
| 51 | 0.297 | 0.257 | 0.215 | 0.014 | 0.004 | 0.022 | 0.350 | 8.01 | 0.509 | 1.727 | 0.0460 | — | 0.130 | — | 0.289 | 0.010 | 21.0 | 9.55 | 165 |
| 52 | 0.083 | 0.346 | 0.812 | 0.032 | 0.009 | 0.054 | 0.331 | 11.82 | 0.178 | 2.066 | 0.0283 | — | 0.610 | — | 0.437 | 0.011 | 23.0 | 16.2 | 185 |
| 53 | 0.280 | 0.120 | 0.471 | 0.016 | 0.003 | 0.080 | 0.102 | 10.95 | 0.143 | 1.821 | 0.0278 | — | 0.572 | — | 0.330 | 0.004 | 19.2 | 10.9 | 188 |
| 54 | 0.076 | 0.503 | 0.944 | 0.015 | 0.008 | 0.070 | 0.196 | 11.34 | 0.591 | 1.461 | 0.0137 | — | 0.690 | — | 0.441 | 0.012 | 21.3 | 3.30 | 200 |
| 55 | 0.246 | 0.076 | 0.774 | 0.014 | 0.006 | 0.089 | 0.245 | 8.88 | 0.705 | 1.435 | 0.0033 | — | 0.643 | — | 0.444 | 0.011 | 21.1 | 9.65 | 247 |
| 56 | 0.264 | 0.550 | 0.513 | 0.022 | 0.003 | 0.107 | 0.333 | 9.51 | 0.672 | 2.212 | 0.0652 | — | 0.619 | — | 0.214 | 0.005 | 20.6 | 4.85 | 209 |
| 57 | 0.043 | 0.115 | 0.310 | 0.046 | 0.002 | 0.095 | 0.323 | 11.70 | 0.190 | 0.520 | 0.0693 | — | 0.809 | — | 0.225 | 0.014 | 21.6 | 5.42 | 115 |
| 58 | 0.213 | 0.087 | 0.311 | 0.014 | 0.004 | 0.068 | 0.066 | 8.80 | 0.420 | 1.799 | 0.0335 | — | 0.892 | — | 0.351 | 0.006 | 15.9 | 6.88 | 215 |
| 59 | 0.248 | 0.224 | 0.668 | 0.012 | 0.001 | 0.097 | 0.100 | 9.33 | 0.067 | 2.798 | 0.0265 | — | 0.074 | — | 0.268 | 0.002 | 15.4 | 5.07 | 166 |
| 60 | 0.206 | 0.297 | 0.748 | 0.049 | 0.004 | 0.103 | 0.074 | 11.79 | 0.839 | 2.783 | 0.0192 | — | 0.542 | — | 0.456 | 0.006 | 22.3 | 9.67 | 145 |
| 61 | 0.141 | 0.436 | 0.682 | 0.013 | 0.007 | 0.101 | 0.280 | 12.03 | 0.402 | 2.144 | — | 0.209 | 0.468 | — | 0.186 | 0.004 | 23.2 | 9.25 | 106 |
| 62 | 0.112 | 0.410 | 0.635 | 0.010 | 0.006 | 0.062 | 0.365 | 8.54 | 0.950 | 2.671 | — | 0.712 | 0.067 | — | 0.339 | 0.007 | 15.0 | 13.3 | 150 |
| 63 | 0.165 | 0.744 | 0.345 | 0.029 | 0.002 | 0.054 | 0.178 | 9.71 | 0.667 | 1.021 | — | 0.123 | 0.986 | — | 0.180 | 0.010 | 24.5 | 10.6 | 232 |
| 64 | 0.214 | 0.031 | 0.765 | 0.036 | 0.003 | 0.046 | 0.480 | 8.99 | 0.739 | 2.675 | — | 0.243 | 0.934 | — | 0.392 | 0.017 | 18.7 | 10.6 | 228 |
| 65 | 0.164 | 0.349 | 0.836 | 0.039 | 0.004 | 0.054 | 0.454 | 12.25 | 0.842 | 1.840 | — | 0.067 | 0.102 | — | 0.440 | 0.011 | 19.4 | 9.12 | 166 |
| 66 | 0.218 | 0.308 | 0.724 | 0.045 | 0.005 | 0.102 | 0.416 | 8.02 | 0.682 | 2.775 | — | 0.146 | 0.176 | — | 0.207 | 0.017 | 23.6 | 15.7 | 228 |
| 67 | 0.286 | 0.441 | 0.577 | 0.043 | 0.001 | 0.055 | 0.452 | 12.29 | 0.954 | 2.209 | — | 0.053 | 0.348 | — | 0.372 | 0.008 | 23.1 | 11.9 | 139 |
| 68 | 0.276 | 0.099 | 0.928 | 0.020 | 0.008 | 0.031 | 0.407 | 8.32 | 0.816 | 1.771 | — | 0.471 | 0.768 | — | 0.401 | 0.008 | 19.5 | 14.3 | 150 |
| 69 | 0.239 | 0.215 | 0.342 | 0.022 | 0.009 | 0.102 | 0.376 | 9.67 | 0.969 | 0.759 | — | 0.139 | 0.179 | — | 0.167 | 0.009 | 20.1 | 4.70 | 144 |
| 70 | 0.089 | 0.165 | 0.970 | 0.038 | 0.001 | 0.036 | 0.446 | 9.77 | 0.121 | 0.892 | — | 0.214 | 0.241 | — | 0.156 | 0.016 | 16.7 | 13.7 | 222 |
| 71 | 0.027 | 0.081 | 0.551 | 0.015 | 0.006 | 0.097 | 0.240 | 11.99 | 0.917 | 2.561 | 0.0707 | 0.013 | 0.114 | — | 0.436 | 0.014 | 20.7 | 15.5 | 108 |
| 72 | 0.095 | 0.495 | 0.430 | 0.020 | 0.005 | 0.111 | 0.299 | 9.77 | 0.568 | 2.552 | 0.0031 | 0.166 | 0.035 | — | 0.274 | 0.015 | 19.7 | 13.5 | 138 |
| 73 | 0.077 | 0.022 | 0.788 | 0.042 | 0.005 | 0.093 | 0.265 | 9.21 | 0.779 | 1.373 | 0.0272 | 0.010 | 0.181 | — | 0.365 | 0.014 | 20.1 | 9.92 | 112 |
| 74 | 0.016 | 0.748 | 0.562 | 0.048 | 0.004 | 0.113 | 0.444 | 8.66 | 0.731 | 0.704 | 0.0626 | 0.054 | 0.231 | — | 0.179 | 0.014 | 19.1 | 14.4 | 132 |
| 75 | 0.260 | 0.082 | 0.296 | 0.045 | 0.008 | 0.090 | 0.243 | 11.54 | 0.104 | 2.254 | 0.0780 | 0.388 | 0.378 | — | 0.182 | 0.019 | 18.4 | 8.75 | 228 |
| 76 | 0.137 | 0.511 | 0.940 | 0.041 | 0.004 | 0.041 | 0.194 | 8.78 | 0.081 | 1.492 | 0.0907 | 0.307 | 0.797 | — | 0.456 | 0.005 | 24.8 | 9.23 | 201 |
| 77 | 0.278 | 0.620 | 0.241 | 0.023 | 0.009 | 0.034 | 0.155 | 8.79 | 0.844 | 2.616 | 0.0697 | 0.045 | 0.180 | — | 0.470 | 0.010 | 15.1 | 4.46 | 153 |
| 78 | 0.156 | 0.541 | 0.342 | 0.017 | 0.005 | 0.089 | 0.434 | 9.98 | 0.084 | 2.337 | 0.0340 | 0.083 | 0.701 | — | 0.295 | 0.003 | 16.3 | 4.30 | 188 |
| 79 | 0.120 | 0.051 | 0.607 | 0.014 | 0.008 | 0.025 | 0.445 | 8.37 | 0.984 | 2.421 | 0.0034 | 0.022 | 0.574 | — | 0.213 | 0.014 | 15.4 | 4.31 | 187 |
| 80 | 0.226 | 0.467 | 0.788 | 0.019 | 0.006 | 0.112 | 0.056 | 9.90 | 0.265 | 0.856 | 0.0954 | 0.038 | 0.482 | — | 0.104 | 0.002 | 24.1 | 14.2 | 101 |
| 81 | 0.235 | 0.360 | 0.620 | 0.040 | 0.009 | 0.115 | 0.229 | 10.42 | 0.565 | 0.505 | — | — | — | 0.082 | 0.433 | 0.014 | 19.2 | 15.4 | 106 |
| 82 | 0.056 | 0.280 | 0.265 | 0.024 | 0.002 | 0.057 | 0.171 | 10.94 | 0.111 | 1.953 | — | — | — | 0.017 | 0.482 | 0.018 | 17.9 | 3.78 | 236 |
| 83 | 0.037 | 0.372 | 0.280 | 0.040 | 0.009 | 0.057 | 0.408 | 9.95 | 0.580 | 0.629 | — | — | — | 0.028 | 0.125 | 0.009 | 16.9 | 16.9 | 139 |
| 84 | 0.086 | 0.379 | 0.392 | 0.015 | 0.009 | 0.027 | 0.338 | 8.22 | 0.140 | 1.935 | — | — | — | 0.036 | 0.233 | 0.007 | 17.8 | 7.96 | 143 |
| 85 | 0.105 | 0.067 | 0.764 | 0.014 | 0.002 | 0.044 | 0.063 | 11.82 | 0.497 | 1.436 | — | — | — | 0.065 | 0.280 | 0.008 | 18.0 | 8.27 | 205 |
| 86 | 0.017 | 0.375 | 0.758 | 0.049 | 0.001 | 0.022 | 0.113 | 11.72 | 0.350 | 2.072 | — | — | — | 0.083 | 0.152 | 0.014 | 19.0 | 13.0 | 200 |
| 87 | 0.157 | 0.256 | 0.504 | 0.024 | 0.008 | 0.032 | 0.338 | 11.23 | 0.360 | 0.532 | — | — | — | 0.019 | 0.113 | 0.002 | 17.8 | 4.10 | 233 |
| 88 | 0.148 | 0.263 | 0.962 | 0.028 | 0.004 | 0.041 | 0.157 | 11.37 | 0.724 | 1.066 | — | — | — | 0.067 | 0.243 | 0.012 | 21.4 | 11.9 | 107 |
| 89 | 0.043 | 0.142 | 0.681 | 0.049 | 0.002 | 0.118 | 0.103 | 10.56 | 0.641 | 2.890 | — | — | — | 0.022 | 0.215 | 0.019 | 16.4 | 11.0 | 147 |
| 90 | 0.184 | 0.044 | 0.213 | 0.012 | 0.003 | 0.033 | 0.482 | 9.75 | 0.789 | 2.704 | — | — | — | 0.033 | 0.106 | 0.010 | 19.7 | 11.3 | 235 |
| 91 | 0.194 | 0.501 | 0.498 | 0.047 | 0.004 | 0.103 | 0.480 | 12.32 | 0.351 | 2.238 | 0.0009 | — | — | 0.074 | 0.185 | 0.013 | 23.4 | 8.33 | 172 |
| 92 | 0.271 | 0.501 | 0.500 | 0.021 | 0.002 | 0.099 | 0.408 | 11.80 | 0.027 | 1.969 | 0.0340 | — | — | 0.072 | 0.339 | 0.016 | 24.4 | 4.68 | 138 |
| 93 | 0.182 | 0.572 | 0.368 | 0.021 | 0.004 | 0.038 | 0.350 | 9.11 | 0.998 | 2.356 | 0.0831 | — | — | 0.087 | 0.233 | 0.011 | 24.2 | 16.7 | 232 |
| 94 | 0.264 | 0.455 | 0.225 | 0.034 | 0.005 | 0.088 | 0.156 | 12.52 | 0.430 | 2.589 | 0.0177 | — | — | 0.091 | 0.339 | 0.013 | 20.0 | 5.44 | 186 |
| 95 | 0.287 | 0.324 | 0.660 | 0.048 | 0.001 | 0.020 | 0.375 | 8.21 | 0.054 | 1.936 | 0.0569 | — | — | 0.058 | 0.142 | 0.005 | 23.5 | 8.32 | 103 |
| 96 | 0.162 | 0.308 | 0.599 | 0.031 | 0.006 | 0.101 | 0.183 | 9.48 | 0.518 | 2.105 | 0.0196 | — | — | 0.093 | 0.111 | 0.010 | 16.7 | 13.9 | 233 |
| 97 | 0.083 | 0.547 | 0.585 | 0.030 | 0.002 | 0.050 | 0.108 | 9.70 | 0.019 | 0.996 | 0.0722 | — | — | 0.077 | 0.119 | 0.012 | 16.4 | 10.9 | 232 |
| 98 | 0.252 | 0.429 | 0.794 | 0.012 | 0.001 | 0.037 | 0.479 | 10.02 | 0.267 | 2.957 | 0.0378 | — | — | 0.076 | 0.447 | 0.015 | 19.6 | 9.07 | 128 |
| 99 | 0.146 | 0.093 | 0.967 | 0.026 | 0.001 | 0.081 | 0.241 | 11.24 | 0.928 | 0.867 | 0.0828 | — | — | 0.013 | 0.370 | 0.005 | 23.0 | 4.02 | 250 |

TABLE 2-continued (Wt. %) Invention Steels

| No. | C | Si | Mn | P | S | Nb | V | Cr | Mo | W | Zr | Ta | Hf | Ti | N | O | CS kg/mm² | VE kgf · m | TO μm |
|---|---|---|---|---|---|---|---|---|---|---|---|---|---|---|---|---|---|---|---|
| 100 | 0.109 | 0.072 | 0.449 | 0.039 | 0.007 | 0.099 | 0.159 | 11.86 | 0.210 | 1.484 | 0.0758 | — | — | 0.042 | 0.363 | 0.011 | 23.7 | 12.2 | 174 |

CS: Creep rupture strength at 650° C., 150 thousand hours
VE: Charpy absorption energy at 0° C. after aging at 700° C. for 10 thousand hours
TO: Oxidation scale thickness after oxidation at 650° C. for 10 thousand hours in air

TABLE 3

(Wt. %) Invention Steels

| No. | C | Si | Mn | P | S | Nb | V | Cr | Mo | W | Zr | Ta | Hf | Ti | N | O | CS kg/mm² | VE kgf · m | TO μm |
|---|---|---|---|---|---|---|---|---|---|---|---|---|---|---|---|---|---|---|---|
| 101 | 0.048 | 0.124 | 0.995 | 0.018 | 0.007 | 0.060 | 0.091 | 10.28 | 0.779 | 1.508 | — | 0.544 | — | 0.089 | 0.297 | 0.011 | 23.3 | 8.29 | 153 |
| 102 | 0.161 | 0.777 | 0.344 | 0.030 | 0.008 | 0.084 | 0.112 | 9.88 | 0.817 | 1.368 | — | 0.675 | — | 0.080 | 0.447 | 0.017 | 23.9 | 8.96 | 142 |
| 103 | 0.071 | 0.230 | 0.250 | 0.023 | 0.002 | 0.088 | 0.319 | 9.16 | 0.039 | 1.591 | — | 0.772 | — | 0.078 | 0.489 | 0.004 | 17.2 | 9.70 | 241 |
| 104 | 0.117 | 0.196 | 0.870 | 0.025 | 0.005 | 0.042 | 0.341 | 9.06 | 0.106 | 2.627 | — | 0.021 | — | 0.055 | 0.298 | 0.013 | 20.2 | 6.30 | 182 |
| 105 | 0.213 | 0.034 | 0.746 | 0.023 | 0.005 | 0.064 | 0.261 | 10.46 | 0.216 | 1.174 | — | 0.912 | — | 0.072 | 0.148 | 0.010 | 24.7 | 15.3 | 215 |
| 106 | 0.269 | 0.288 | 0.436 | 0.025 | 0.008 | 0.074 | 0.393 | 11.91 | 0.560 | 1.502 | — | 0.319 | — | 0.056 | 0.320 | 0.009 | 17.5 | 4.28 | 144 |
| 107 | 0.045 | 0.313 | 0.479 | 0.018 | 0.006 | 0.089 | 0.367 | 9.22 | 0.323 | 1.528 | — | 0.065 | — | 0.025 | 0.478 | 0.011 | 15.8 | 4.09 | 225 |
| 108 | 0.037 | 0.273 | 0.642 | 0.030 | 0.006 | 0.030 | 0.498 | 8.45 | 0.696 | 1.762 | — | 0.328 | — | 0.041 | 0.111 | 0.013 | 16.2 | 10.2 | 108 |
| 109 | 0.296 | 0.702 | 0.674 | 0.028 | 0.005 | 0.064 | 0.195 | 8.04 | 0.374 | 1.422 | — | 0.249 | — | 0.029 | 0.288 | 0.017 | 20.5 | 11.1 | 120 |
| 110 | 0.146 | 0.540 | 0.288 | 0.038 | 0.009 | 0.109 | 0.427 | 11.18 | 0.007 | 2.138 | — | 0.524 | — | 0.051 | 0.270 | 0.017 | 20.8 | 16.6 | 142 |
| 111 | 0.229 | 0.767 | 0.884 | 0.031 | 0.006 | 0.037 | 0.399 | 11.64 | 0.328 | 1.998 | 0.0334 | 0.049 | — | 0.036 | 0.157 | 0.018 | 24.0 | 15.4 | 127 |
| 112 | 0.163 | 0.324 | 0.984 | 0.032 | 0.003 | 0.064 | 0.411 | 12.66 | 0.495 | 2.660 | 0.0659 | 0.047 | — | 0.045 | 0.407 | 0.012 | 21.7 | 16.9 | 101 |
| 113 | 0.290 | 0.149 | 0.750 | 0.049 | 0.006 | 0.059 | 0.327 | 10.27 | 0.721 | 0.882 | 0.0903 | 0.122 | — | 0.049 | 0.302 | 0.005 | 16.0 | 9.83 | 168 |
| 114 | 0.083 | 0.381 | 0.717 | 0.030 | 0.003 | 0.041 | 0.445 | 10.29 | 0.162 | 0.807 | 0.0752 | 0.171 | — | 0.065 | 0.110 | 0.007 | 18.6 | 3.81 | 132 |
| 115 | 0.035 | 0.393 | 0.647 | 0.042 | 0.004 | 0.029 | 0.184 | 11.29 | 0.028 | 2.970 | 0.0407 | 0.012 | — | 0.066 | 0.113 | 0.014 | 21.6 | 15.5 | 171 |
| 116 | 0.201 | 0.330 | 0.284 | 0.013 | 0.008 | 0.042 | 0.076 | 11.60 | 0.498 | 1.561 | 0.0525 | 0.221 | — | 0.066 | 0.385 | 0.011 | 16.7 | 12.4 | 162 |
| 117 | 0.196 | 0.341 | 0.991 | 0.029 | 0.010 | 0.049 | 0.210 | 9.76 | 0.268 | 2.087 | 0.0831 | 0.154 | — | 0.042 | 0.197 | 0.019 | 15.9 | 11.3 | 134 |
| 118 | 0.078 | 0.566 | 0.501 | 0.020 | 0.008 | 0.067 | 0.436 | 9.15 | 0.017 | 1.210 | 0.0477 | 0.130 | — | 0.051 | 0.228 | 0.005 | 20.9 | 7.80 | 115 |
| 119 | 0.045 | 0.378 | 0.571 | 0.031 | 0.004 | 0.116 | 0.173 | 10.69 | 0.434 | 1.936 | 0.0174 | 0.110 | — | 0.022 | 0.352 | 0.010 | 23.7 | 4.41 | 208 |
| 120 | 0.152 | 0.305 | 0.955 | 0.011 | 0.009 | 0.116 | 0.175 | 10.36 | 0.709 | 0.994 | 0.0109 | 0.342 | — | 0.018 | 0.442 | 0.009 | 16.3 | 10.9 | 217 |
| 121 | 0.019 | 0.109 | 0.995 | 0.028 | 0.006 | 0.084 | 0.075 | 9.06 | 0.024 | 2.564 | — | — | 0.724 | 0.098 | 0.175 | 0.014 | 20.3 | 15.7 | 168 |
| 122 | 0.278 | 0.720 | 0.852 | 0.048 | 0.001 | 0.088 | 0.187 | 10.28 | 0.576 | 0.894 | — | — | 0.621 | 0.056 | 0.429 | 0.012 | 17.6 | 14.5 | 239 |
| 123 | 0.256 | 0.312 | 0.250 | 0.038 | 0.006 | 0.099 | 0.362 | 12.31 | 0.033 | 2.664 | — | — | 0.611 | 0.043 | 0.265 | 0.004 | 15.4 | 3.17 | 238 |
| 124 | 0.162 | 0.623 | 0.574 | 0.028 | 0.003 | 0.084 | 0.246 | 11.30 | 0.109 | 0.891 | — | — | 0.874 | 0.076 | 0.179 | 0.005 | 20.3 | 4.99 | 112 |
| 125 | 0.186 | 0.225 | 0.758 | 0.044 | 0.008 | 0.114 | 0.141 | 8.06 | 0.971 | 2.284 | — | — | 0.124 | 0.038 | 0.232 | 0.008 | 19.2 | 15.8 | 119 |
| 126 | 0.244 | 0.047 | 0.555 | 0.033 | 0.010 | 0.106 | 0.138 | 8.62 | 0.831 | 2.322 | — | — | 0.515 | 0.079 | 0.105 | 0.008 | 19.1 | 10.3 | 210 |
| 127 | 0.097 | 0.613 | 0.502 | 0.024 | 0.009 | 0.028 | 0.083 | 11.27 | 0.843 | 2.655 | — | — | 0.737 | 0.037 | 0.267 | 0.008 | 16.7 | 11.8 | 111 |
| 128 | 0.085 | 0.525 | 0.366 | 0.023 | 0.008 | 0.050 | 0.076 | 12.07 | 0.223 | 2.580 | — | — | 0.500 | 0.018 | 0.199 | 0.001 | 19.0 | 9.18 | 229 |
| 129 | 0.127 | 0.312 | 0.687 | 0.018 | 0.008 | 0.040 | 0.190 | 11.90 | 0.637 | 2.537 | — | — | 0.477 | 0.086 | 0.174 | 0.011 | 22.8 | 5.04 | 215 |
| 130 | 0.126 | 0.121 | 0.821 | 0.017 | 0.001 | 0.068 | 0.066 | 11.73 | 0.291 | 1.743 | — | — | 0.354 | 0.075 | 0.266 | 0.012 | 15.0 | 15.8 | 171 |
| 131 | 0.137 | 0.096 | 0.512 | 0.027 | 0.005 | 0.051 | 0.459 | 9.96 | 0.855 | 1.909 | 0.0215 | — | 0.320 | 0.049 | 0.150 | 0.010 | 17.5 | 9.31 | 203 |
| 132 | 0.216 | 0.391 | 0.323 | 0.016 | 0.006 | 0.060 | 0.335 | 10.11 | 0.043 | 2.292 | 0.0553 | — | 0.083 | 0.070 | 0.303 | 0.006 | 17.2 | 16.2 | 113 |
| 133 | 0.273 | 0.367 | 0.387 | 0.031 | 0.010 | 0.062 | 0.446 | 10.52 | 0.014 | 0.811 | 0.0056 | — | 0.295 | 0.063 | 0.401 | 0.004 | 15.9 | 4.00 | 228 |
| 134 | 0.213 | 0.554 | 0.462 | 0.040 | 0.005 | 0.076 | 0.203 | 9.67 | 0.464 | 1.706 | 0.0411 | — | 0.658 | 0.045 | 0.310 | 0.016 | 20.5 | 10.3 | 202 |
| 135 | 0.095 | 0.720 | 0.299 | 0.049 | 0.003 | 0.021 | 0.368 | 8.51 | 0.087 | 1.695 | 0.0810 | — | 0.864 | 0.080 | 0.116 | 0.002 | 22.9 | 9.79 | 214 |
| 136 | 0.117 | 0.226 | 0.843 | 0.048 | 0.001 | 0.117 | 0.349 | 12.93 | 0.068 | 1.256 | 0.0452 | — | 0.607 | 0.094 | 0.490 | 0.018 | 15.0 | 5.13 | 215 |
| 137 | 0.040 | 0.771 | 0.648 | 0.022 | 0.009 | 0.029 | 0.230 | 11.41 | 0.586 | 0.839 | 0.0996 | — | 0.060 | 0.058 | 0.303 | 0.014 | 18.6 | 5.78 | 234 |
| 138 | 0.213 | 0.552 | 0.253 | 0.040 | 0.001 | 0.029 | 0.314 | 9.81 | 0.328 | 2.143 | 0.0647 | — | 0.899 | 0.078 | 0.231 | 0.010 | 15.5 | 14.4 | 150 |
| 139 | 0.254 | 0.514 | 0.628 | 0.029 | 0.003 | 0.084 | 0.469 | 9.17 | 0.988 | 1.925 | 0.0089 | — | 0.834 | 0.038 | 0.357 | 0.011 | 22.6 | 12.7 | 213 |
| 140 | 0.068 | 0.391 | 0.306 | 0.016 | 0.002 | 0.064 | 0.104 | 12.89 | 0.265 | 1.905 | 0.0516 | — | 0.560 | 0.089 | 0.347 | 0.011 | 17.0 | 3.45 | 156 |
| 141 | 0.295 | 0.339 | 0.648 | 0.010 | 0.009 | 0.039 | 0.204 | 11.91 | 0.336 | 2.541 | — | 0.090 | 0.744 | 0.023 | 0.479 | 0.013 | 15.5 | 3.05 | 155 |
| 142 | 0.121 | 0.123 | 0.203 | 0.037 | 0.008 | 0.025 | 0.401 | 12.19 | 0.886 | 0.572 | — | 0.022 | 0.588 | 0.038 | 0.433 | 0.003 | 19.8 | 14.2 | 237 |
| 143 | 0.176 | 0.651 | 0.714 | 0.046 | 0.009 | 0.042 | 0.102 | 9.61 | 0.107 | 1.418 | — | 0.250 | 0.271 | 0.059 | 0.275 | 0.011 | 21.9 | 4.61 | 132 |
| 144 | 0.225 | 0.131 | 0.336 | 0.043 | 0.001 | 0.059 | 0.293 | 10.13 | 0.177 | 0.586 | — | 0.039 | 0.477 | 0.013 | 0.286 | 0.003 | 18.7 | 4.80 | 242 |
| 145 | 0.035 | 0.667 | 0.427 | 0.037 | 0.007 | 0.096 | 0.167 | 9.79 | 0.309 | 1.075 | — | 0.019 | 0.413 | 0.054 | 0.344 | 0.003 | 22.1 | 10.5 | 222 |
| 146 | 0.093 | 0.048 | 0.722 | 0.014 | 0.008 | 0.068 | 0.246 | 9.38 | 0.660 | 0.774 | — | 0.330 | 0.245 | 0.062 | 0.317 | 0.004 | 23.8 | 3.14 | 246 |
| 147 | 0.019 | 0.771 | 0.981 | 0.022 | 0.008 | 0.048 | 0.170 | 9.91 | 0.437 | 2.723 | — | 0.168 | 0.670 | 0.010 | 0.483 | 0.010 | 20.9 | 13.6 | 122 |
| 148 | 0.158 | 0.251 | 0.952 | 0.049 | 0.006 | 0.102 | 0.473 | 9.82 | 0.320 | 1.099 | — | 0.162 | 0.376 | 0.093 | 0.319 | 0.014 | 20.1 | 9.29 | 174 |
| 149 | 0.128 | 0.189 | 0.780 | 0.022 | 0.003 | 0.099 | 0.338 | 10.00 | 0.494 | 1.381 | — | 0.438 | 0.049 | 0.060 | 0.296 | 0.002 | 18.3 | 6.92 | 133 |
| 150 | 0.273 | 0.731 | 0.616 | 0.049 | 0.010 | 0.059 | 0.299 | 11.40 | 0.153 | 2.779 | — | 0.045 | 0.859 | 0.061 | 0.489 | 0.005 | 17.5 | 9.10 | 249 |

CS: Creep rupture strength at 650° C., 150 thousand hours
VE: Charpy absorption energy at 0° C. after aging at 700° C. for 10 thousand hours
TO: Oxidation scale thickness after oxidation at 650° C. for 10 thousand hours in air

TABLE 4

(Wt. %) Invention Steels

| No. | C | Si | Mn | P | S | Nb | V | Cr | Mo | W | Zr | Ta | Hf | Ti | N | O | CS kg/mm² | VE kgf · m | TO μm |
|---|---|---|---|---|---|---|---|---|---|---|---|---|---|---|---|---|---|---|---|
| 151 | 0.213 | 0.079 | 0.214 | 0.017 | 0.005 | 0.049 | 0.220 | 12.50 | 0.975 | 0.789 | 0.0684 | 0.078 | 0.529 | 0.025 | 0.376 | 0.008 | 24.4 | 4.45 | 104 |
| 152 | 0.149 | 0.326 | 0.523 | 0.013 | 0.004 | 0.039 | 0.178 | 11.70 | 0.161 | 0.844 | 0.0017 | 0.542 | 0.220 | 0.056 | 0.430 | 0.014 | 16.0 | 16.5 | 248 |
| 153 | 0.132 | 0.057 | 0.488 | 0.026 | 0.009 | 0.047 | 0.263 | 9.93 | 0.382 | 2.180 | 0.0271 | 0.297 | 0.619 | 0.038 | 0.125 | 0.018 | 24.1 | 6.08 | 111 |
| 154 | 0.073 | 0.589 | 0.264 | 0.042 | 0.008 | 0.093 | 0.331 | 10.64 | 0.833 | 1.516 | 0.0632 | 0.034 | 0.427 | 0.032 | 0.338 | 0.013 | 20.6 | 3.65 | 244 |

TABLE 4-continued (Wt. %) Invention Steels

| No. | C | Si | Mn | P | S | Nb | V | Cr | Mo | W | Zr | Ta | Hf | Ti | N | O | CS kg/mm² | VE kgf · m | TO μm |
|---|---|---|---|---|---|---|---|---|---|---|---|---|---|---|---|---|---|---|---|
| 155 | 0.028 | 0.512 | 0.402 | 0.029 | 0.003 | 0.045 | 0.469 | 9.80 | 0.213 | 1.841 | 0.0787 | 0.263 | 0.824 | 0.011 | 0.145 | 0.005 | 22.4 | 5.02 | 229 |
| 156 | 0.197 | 0.361 | 0.251 | 0.015 | 0.004 | 0.021 | 0.309 | 10.82 | 0.689 | 1.083 | 0.0423 | 0.036 | 0.997 | 0.081 | 0.420 | 0.004 | 21.3 | 12.4 | 238 |
| 157 | 0.048 | 0.663 | 0.354 | 0.027 | 0.008 | 0.090 | 0.387 | 12.09 | 0.960 | 0.982 | 0.0724 | 0.166 | 0.641 | 0.079 | 0.234 | 0.005 | 24.3 | 8.05 | 231 |
| 158 | 0.222 | 0.409 | 0.472 | 0.013 | 0.004 | 0.022 | 0.337 | 12.12 | 0.218 | 2.006 | 0.0384 | 0.280 | 0.936 | 0.066 | 0.268 | 0.003 | 18.2 | 15.0 | 231 |
| 159 | 0.191 | 0.515 | 0.348 | 0.019 | 0.007 | 0.084 | 0.469 | 11.84 | 0.642 | 2.134 | 0.0582 | 0.195 | 0.571 | 0.060 | 0.394 | 0.019 | 19.8 | 8.23 | 119 |
| 160 | 0.153 | 0.738 | 0.528 | 0.034 | 0.005 | 0.097 | 0.413 | 12.12 | 0.414 | 1.796 | 0.0023 | 0.271 | 0.732 | 0.033 | 0.485 | 0.011 | 21.2 | 4.30 | 222 |

CS: Creep rupture strength at 650° C., 150 thousand hours
VE: Charpy absorption energy at 0° C. after aging at 700° C. for 10 thousand hours
TO: Oxidation scale thickness after oxidation at 650° C. for 10 thousand hours in air

TABLE 5

(Wt. %) Comparison Steels

| No. | C | Si | Mn | P | S | Nb | V | Cr | Mo | W | Zr | Ta | Hf | Ti | N | O | CS (kg/mm²) | VE (kgf · m) | TO (μm) |
|---|---|---|---|---|---|---|---|---|---|---|---|---|---|---|---|---|---|---|---|
| 161 | 0.080 | 0.054 | 0.572 | 0.016 | 0.007 | 0.075 | 0.121 | 8.66 | 0.011 | 1.162 | 0.011 | 0.255 | 0.161 | 0.045 | 0.087 | 0.0021 | 11.4 | 3.2 | 420 |
| 162 | 0.092 | 0.076 | 0.323 | 0.017 | 0.006 | 0.045 | 0.201 | 11.51 | 0.095 | 1.514 | 0.008 | 0.344 | 0.055 | 0.037 | 0.032 | 0.0021 | 10.3 | 3.1 | 430 |
| 163 | 0.121 | 0.101 | 0.812 | 0.003 | 0.005 | 0.042 | 0.222 | 9.22 | 0.252 | 1.889 | 0.077 | 0.337 | 0.056 | 0.036 | 0.524 | 0.0045 | 16.1 | 0.2 | 120 |
| 164 | 0.137 | 0.110 | 0.271 | 0.004 | 0.006 | 0.043 | 0.232 | 10.99 | 0.341 | 2.005 | 0.001 | 0.188 | 0.164 | 0.012 | 0.667 | 0.0078 | 19.9 | 0.7 | 90 |
| 165 | 0.075 | 0.141 | 0.457 | 0.045 | 0.006 | 0.037 | 0.313 | 9.21 | 0.516 | 0.447 | 0.003 | 0.345 | 0.122 | 0.017 | 0.124 | 0.0065 | 7.5 | 8.7 | 140 |
| 166 | 0.099 | 0.080 | 0.724 | 0.042 | 0.009 | 0.048 | 0.344 | 9.33 | 0.557 | 2.123 | 0.131 | 0.895 | 0.016 | 0.025 | 0.155 | 0.0043 | 15.5 | 0.4 | 130 |
| 167 | 0.102 | 0.156 | 0.889 | 0.027 | 0.002 | 0.062 | 0.411 | 9.45 | 0.616 | 1.156 | 0.015 | 1.212 | 0.999 | 0.066 | 0.166 | 0.0152 | 19.4 | 0.1 | 80 |
| 168 | 0.033 | 0.092 | 0.233 | 0.018 | 0.002 | 0.063 | 0.056 | 9.13 | 0.709 | 0.871 | 0.045 | 0.962 | 1.045 | 0.088 | 0.176 | 0.0117 | 16.7 | 0.1 | 120 |
| 169 | 0.052 | 0.244 | 0.475 | 0.021 | 0.002 | 0.051 | 0.099 | 10.56 | 0.989 | 0.558 | 0.099 | 0.037 | 0.087 | 0.119 | 0.201 | 0.0169 | 17.1 | 0.3 | 80 |
| 170 | 0.071 | 0.163 | 0.502 | 0.016 | 0.003 | 0.049 | 0.212 | 9.15 | 0.442 | 2.002 | 0.020 | — | — | — | 0.223 | 0.0051 | 3.1 | 0.2 | 110 |

CS: Creep rupture strength at 650° C., 150 thousand hours
VE: Charpy absorption energy at 0° C. after aging at 700° C. for 10 thousand hours
TO: Oxidation scale thickness after oxidation at 650° C. for 10 thousand hours in air The present invention provides a high-nitrogen ferritic heat-resisting steel exhibiting a high rupture strength after prolonged creep and superior high-temperature oxidation resistance and, as such, can be expected to make a major contribution to industrial progress.

What is claimed is:

1. A high-nitrogen ferritic heat-resisting steel comprising in weight per cent
0.01–0.30% C,
0.02–0.80% Si,
0.20–1.00% Mn,
8.00–13.00% Cr,
0.005–1.00% Mo,
0.50–3.00% W,
0.05–0.50% V,
0.02–0.12% Nb, and
0.10–0.50% N,
and one or more of 0.01–1.0% Ta, 0.01–1.0% Hf, 0.0005–0.10% Zr and 0.01–0.1% Ti for improving creep characteristics and toughness of the steel through the effect of finely precipitated nitrides and carbo-nitrides, and being controlled to include
not more than 0.050% P,
not more than 0.010% S, and
not more than 0.020% O,
the remainder being Fe and unavoidable impurities.

2. A high-nitrogen ferritic heat-resisting steel comprising, in weight per cent
0.01–0.30% C,
0.02–0.80% Si,
0.20–1.00% Mn,
8.00–13.00% Cr,
0.005–1.00% Mo,
0.50–3.00% W,
0.05–0.50% V,
0.02–0.12% Nb,
0.10–0.50% N,
and one or both of
0.01–1.00% Ta and
0.01–1.00% Hf
and being controlled to include
not more than 0.050% P,
not more than 0.010% S, and
not more than 0.020% O,
the remainder being Fe and unavoidable impurities.

3. A high-nitrogen ferritic heat-resisting steel comprising, in weight per cent
0.01–0.30% C,
0.02–0.80% Si,
0.20–1.00% Mn,
8.00–13.00% Cr,
0.005–1.00% Mo,
0.50–3.00% W,
0.05–0.50% V,
0.02–0.12% Nb,
0.10–0.50% N,
and one or both of
0.0005–0.10% Zr and
0.01–0.10% Ti
and being controlled to include
not more than 0.050% P,
not more than 0.010% S, and
not more than 0.020% O,
the remainder being Fe and unavoidable impurities.

4. A high-nitrogen ferritic heat-resisting steel comprising, in weight per cent
0.01–0.30% C,
0.02–0.80% Si,
0.20–1.00% Mn,
8.00–13.00% Cr,
0.005–1.00% Mo,
0.50–3.00% W,
0.05–0.50% V, 0.02–0.12% Nb,
0.10–0.50% N,
one or both of
0.01–1.00% Ta and
0.01–1.00% Hf
and one or both of
0.0005–0.10% Zr and
0.01–0.10% Ti
and being controlled to include
not more than 0.050% P,
not more than 0.010% S, and
not more than 0.020% O,
the remainder being Fe and unavoidable impurities.

* * * * *